US005620152A

United States Patent [19]

Sargent

[11] Patent Number: 5,620,152

[45] Date of Patent: Apr. 15, 1997

[54] TETHERED MISSILE SYSTEM

[75] Inventor: Stephen V. Sargent, Stevenage, Great Britain

[73] Assignee: British Aerospace Public Limited Company, Farnborough, United Kingdom

[21] Appl. No.: 589,561

[22] Filed: Jan. 22, 1996

[30] Foreign Application Priority Data

Jan. 27, 1995 [GB] United Kingdom ..... 9501594

[51] Int. Cl.[6] ..... F42B 15/04

[52] U.S. Cl. ..... 244/3.12

[58] Field of Search ..... 244/3.12, 3.22; 114/21.1, 21.2

[56] References Cited

U.S. PATENT DOCUMENTS

| | | | |
|---|---|---|---|
| 2,491,825 | 12/1949 | Meister | 46/77 |
| 2,587,432 | 2/1952 | Bellah | 242/96 |
| 2,801,571 | 8/1957 | Lusser | 89/1.7 |
| 2,948,489 | 8/1960 | Miller, Jr. et al. | 244/17.17 |
| 3,043,197 | 7/1962 | Piper et al. | 244/3.12 |
| 3,090,198 | 5/1963 | Zeisloft | 60/35.55 |
| 3,172,230 | 3/1965 | Smith | 46/75 |
| 3,195,462 | 7/1965 | Petre | 102/49 |
| 5,012,991 | 5/1991 | Pinson | 244/3.12 |
| 5,031,982 | 7/1991 | Redford | 350/96.1 |
| 5,310,134 | 5/1994 | Hsu et al. | 244/3.12 |
| 5,346,159 | 9/1994 | Dekel | 244/3.12 |
| 5,456,425 | 10/1995 | Morris et al. | 244/3.22 |

FOREIGN PATENT DOCUMENTS

| | | |
|---|---|---|
| 0337254 | 10/1989 | European Pat. Off. . |
| 0503789 | 9/1992 | European Pat. Off. . |
| 0576059 | 12/1993 | European Pat. Off. . |
| 1035553 | 8/1953 | France . |
| 2341122 | 9/1977 | France . |
| 2701919 | 9/1994 | France . |
| 3442974 | 3/1986 | Germany . |
| 1467552 | 3/1977 | United Kingdom . |
| 2020789 | 4/1979 | United Kingdom . |
| 2086321 | 5/1982 | United Kingdom . |
| 2169066 | 7/1986 | United Kingdom . |

*Primary Examiner*—Michael J. Carone
*Assistant Examiner*—Theresa M. Wesson
*Attorney, Agent, or Firm*—Nixon & Vanderhye P.C.

[57] ABSTRACT

A missile (1) suitable for intercepting an airborne anti-tank threat is tethered to a ground station by control cables (9A,9B,9C,10). By altering the tension on the cables (9A, 9B,9C) a vectored thrust nozzle arrangement (6,7) is rotated in order to control missile (1) attitude thereby enabling it to intercept an oncoming target.

9 Claims, 3 Drawing Sheets

TETHERED MISSILE SYSTEM

Figure 1:
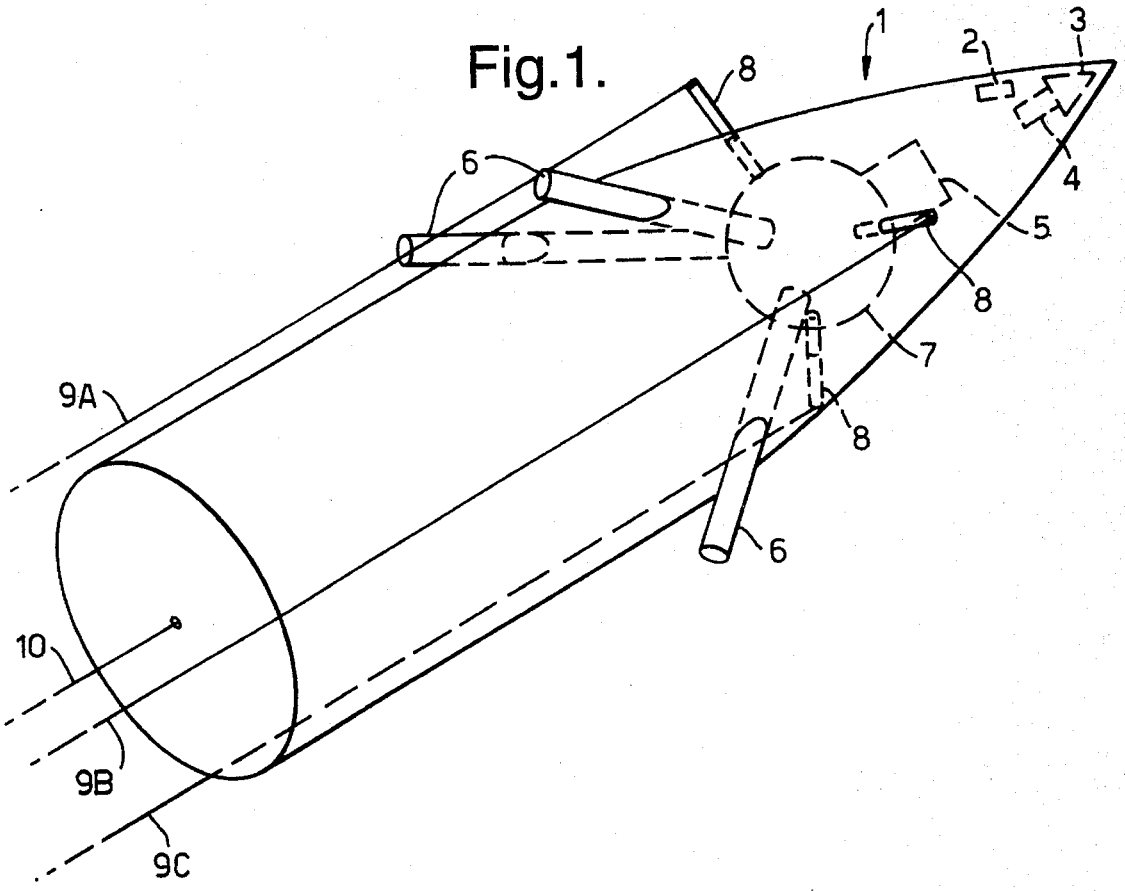

This invention relates to missile systems and particularly to those incorporating a stabilising cable extending between a missile and a launcher.

GB-A-2020789 discloses a missile which is stabilised during launch by a cable brake. The cable is stored on a reel at the launch point and unwinds during launch to produce an aligning force on the missile during flight. At the end of the stabilising phase, the cable is detached from the rear of the missile and plays no further part in the missile's guidance.

According to the present invention, a missile launch and control system comprises a missile, a launch station for launching the missile therefrom, and cable means for tethering the missile to the launch station, characterised in that the cable means are arranged to control a vectored thrust mechanism located on board the missile for controlling the lateral position thereof.

By virtue of the invention, the missile is able to hover like a kite at the end of its tether cable means and manoeuvre laterally in order to intercept an airborne target.

The missile could be tethered and controlled from a tank and deployed to intercept an anti-tank missile. In this case, equipment for tracking and guidance of the tethered missile could conveniently be based in the tank system.

The cable means which run from the launch station to the missile may serve both to tether the missile and to operate the vectored thrust mechanism simultaneously. Alternatively, a separate tethering cable may be employed with additional control cables. All cables may be stored on spools, co-located at the launch station and are preferably composed of aramid fibre (eg. Kevlar RTM).

The vectored thrust mechanism may incorporate one or more exhaust nozzles. In a preferred embodiment, three vectored thrust nozzles are employed in order to give the missile good manoeuvrability. The nozzles are controlled by three control cables and an optional fourth cable serves solely as a tether. Control may then be achieved by altering the relative tension in each of the three control cables by means of a cable hook arrangement and rotatable turntable located at the launch station. This will change the lateral position of the missile by changing the direction of the missile's thrust. The component of the missile thrust perpendicular to the control lines will produce lateral acceleration.

The tension on the cable means can be minimised but maintained throughout the missile's flight by braking a cable payout spool halfway through the flight. This allows the missile to be controlled while it is still flying out to the length of the tether cable.

Preferably, any on-board missile motor (which exhausts through the nozzles) produces a constant thrust for the time the missile is active.

Optionally and located on board a tank for example an infra-red (IR) camera can be used to track both the target threat and the tethered missile.

Using information provided by the infra-red camera, the missile can be steered (by means of the control cables) onto the same sightline as the threat.

Figure 2:
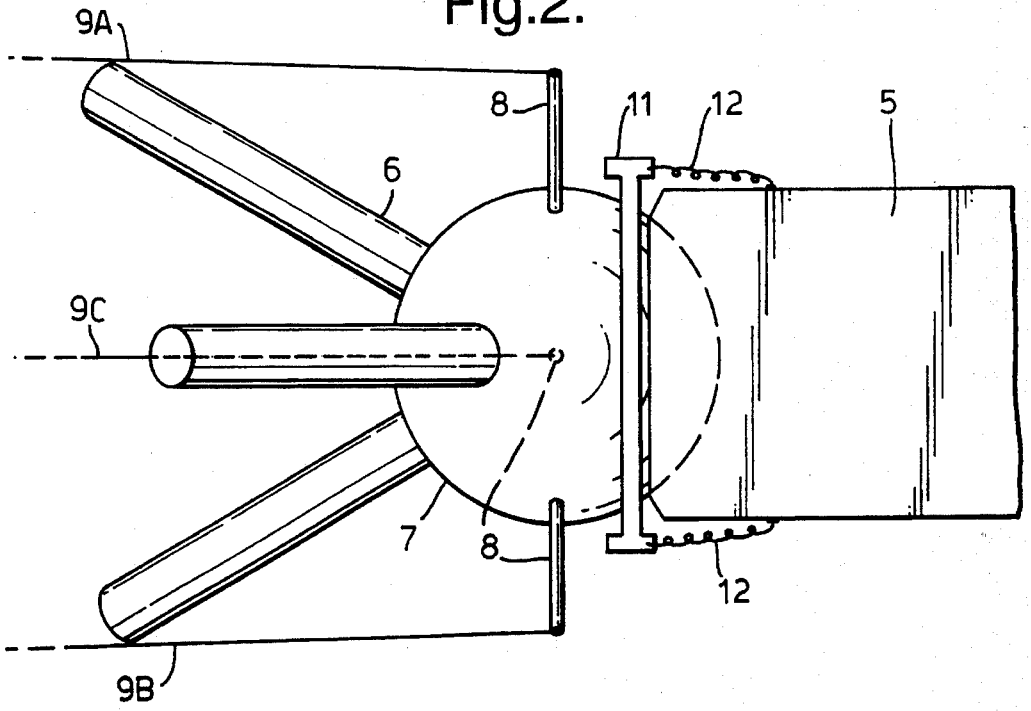
Figure 3:
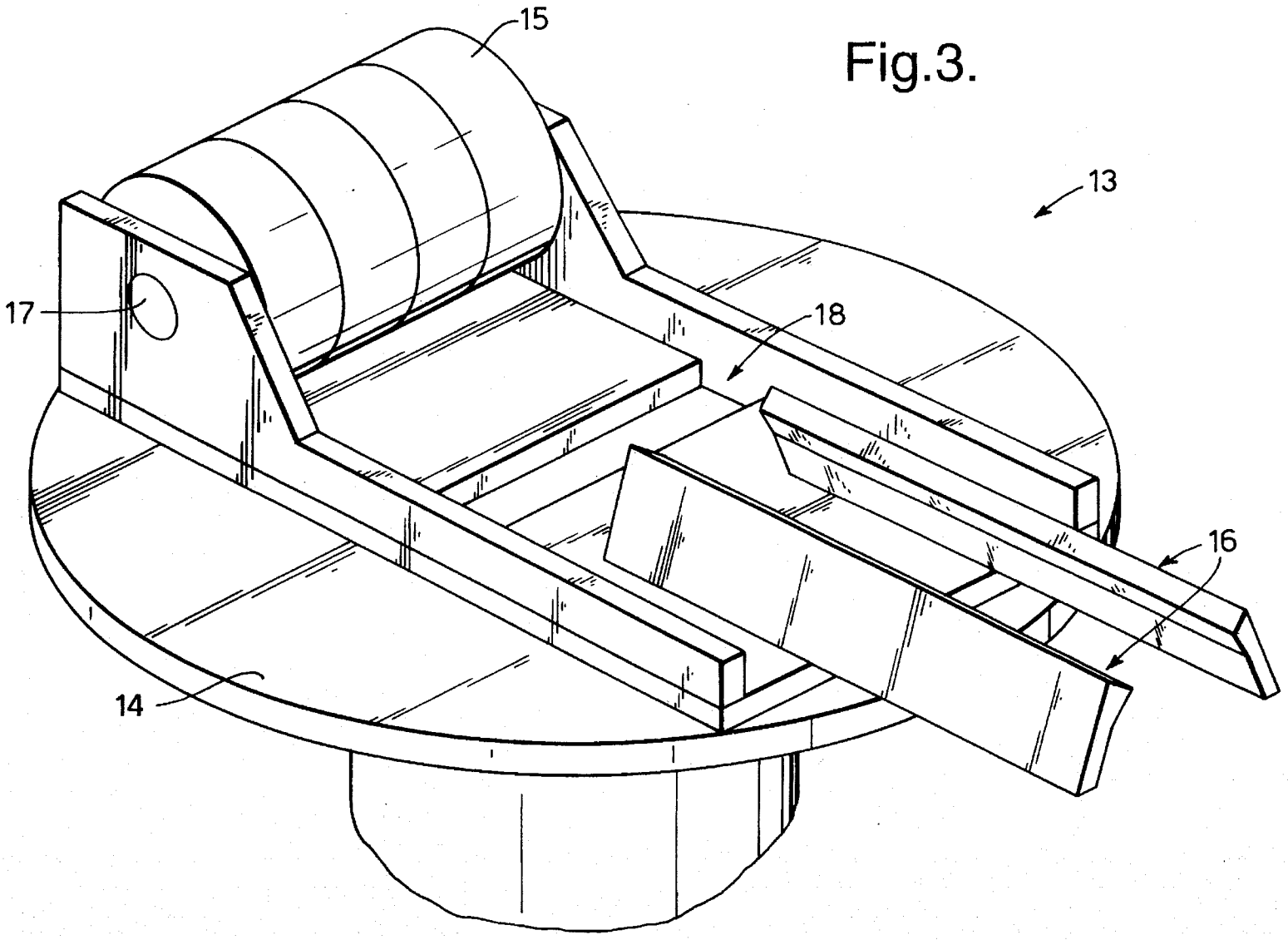
Figure 4:
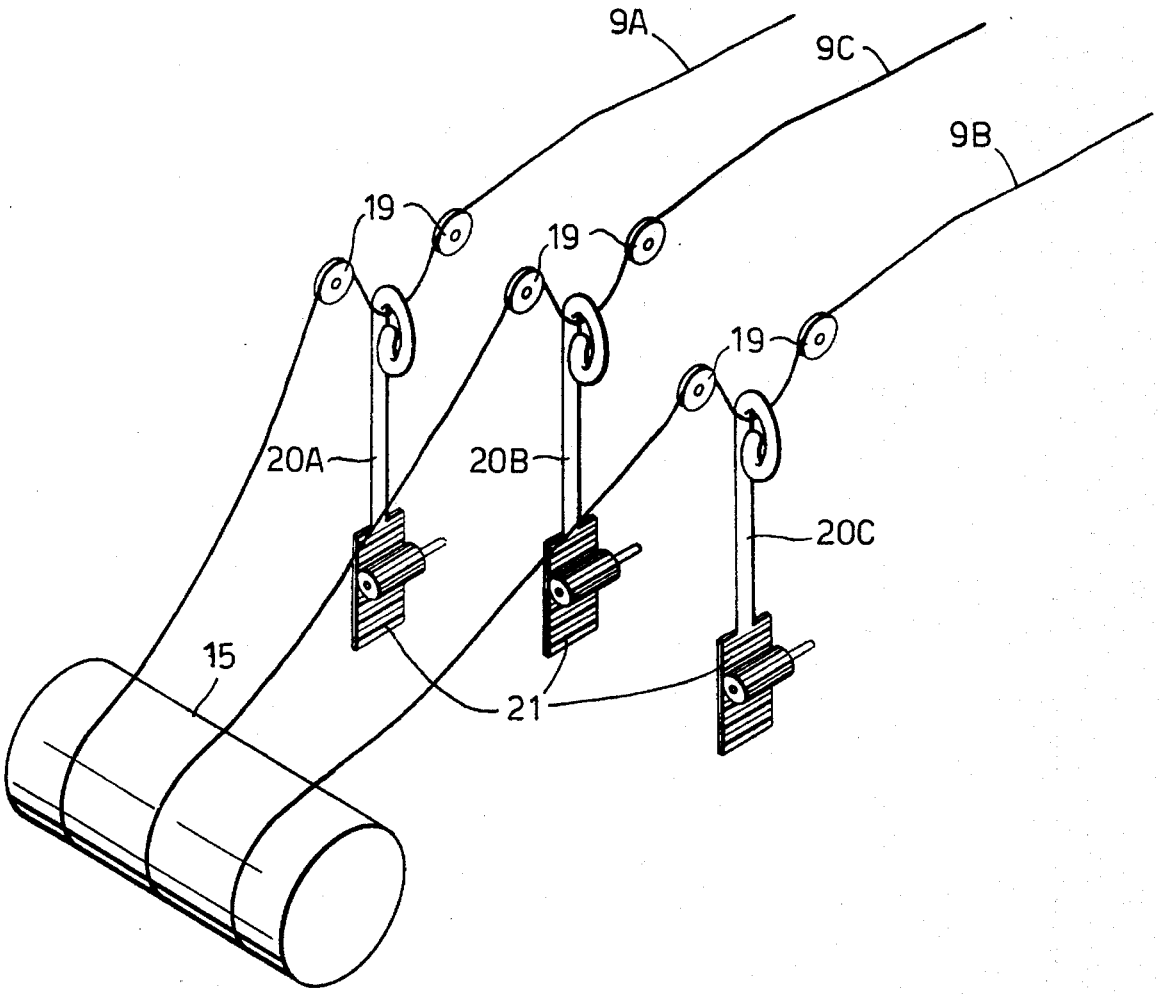

An embodiment of a tethered missile system will now be described, by way of example only, with reference to the drawings of which:

FIG. 1 is a schematic perspective view of a tethered missile in accordance with the invention, FIG. 2 is a schematic perspective view of a thrust vectoring mechanism incorporated in the missile of FIG. 1, FIG. 3 is a perspective view of apparatus comprising a launcher unit for use in conjunction with the missile of FIG. 1 and FIG. 4 is a schematic representation of constituent parts of a cable control actuator for use in conjunction with the launcher unit of FIG. 3, Referring to FIG. 1, a missile 1 contains a proximity fuze 2, of the inductance loop type, a warhead 3 incorporating a safety and arming unit 4, and a motor 5 whose efflux is exhausted through three side-venting nozzles 6. The side-venting nozzles 6 are arranged symmetrically around the missile body 1 and are in a fixed position relative to one another. The nozzles 6 are connected to a gimballed ball mechanism 7, as are three control arms 8 which protrude through the missile body 1.

To an end of each control arm 8 is attached a Kevlar (RTM) control cable 9A, 9B, 9C. These cables terminate at the launcher and are used to rotate the ball 7 and nozzles 6 thus vectoring thrust to produce lateral acceleration of the missile body 1. A fourth thicker cable 10, also made from Kevlar (RTM) is secured to the rear of the missile 1 and terminates at the launcher. This fourth cable 10 acts as a tether.

The missile motor 5 is located Just forward of the centre of the missile 1, and comprises a cigarette burner producing a constant thrust of 2800N.

Referring now to FIG. 2, the ball 7 is held in a socket in the motor casing 5 by a gimbal 11 which is attached to the motor casing by recentring springs 12.

When the ball 7 is undisplaced the three side venting nozzles 6 are at 30° to the main missile axis. The maximum displacement of the ball is typically 20°. At this displacement one side venting nozzle 6 lies between 10° and 50° and the other two lie between 43° and 25° to the main axis. With no deflection on the ball 7, the motor provides 2000N forward thrust and at maximum deflection the nozzles 6 give 700N side thrust. Motor thrust lasts for typically 4 seconds. When the missile 1 is in flight the control wires 9A, 9B and 9C will be under tension. Increasing the tension on one of the control wires will produce a torque on the ball 7 (via the relevant control arms 8) causing it and the nozzles 6 to rotate in order to equalise the tension on each of the control wires.

The missile launching and control mechanism will now be described with reference to FIGS. 3 and 4. The mechanism comprises a fixed launcher and a disposable launch unit 13. The fixed launcher includes a rotatable turntable 14 and an actuator mechanism (shown in FIG. 4) for controlling the tension on the missile's control cables 9A, 9B and 9C.

The disposable launch unit 13 together with the missile 1 comprises a "round" and it is envisaged that the tethered missile system will be capable of firing a succession of rounds.

Each missile has its own set of cabling which must be connected and disconnected to the actuator mechanism before and after each launch.

The launch unit 13 contains a set of spindles 15 of Kevlar cabling and launch rails 16 for the missile.

The spindles 15 are provided with a friction brake 17 and are ratcheted when not loaded to keep the tension on each of the cables. The act of loading the round into the launcher will release the ratchet but fix the spindles together thus ensuring that equal amounts of cable are released from each spindle.

Once a round has been loaded into the launcher 13 the cable control actuator of FIG. 4 extends through a slot 18 in the bottom of the launch unit 13.

FIG. 4 shows the set of spindles 15 carrying the two upper control cables 9A and 9B and the lower control cable 9C. The tether cable 10 has been omitted from this figure for the sake of clarity. Cable trainers 19 hold each cable at two points whilst cable hooks 20A, 20B and 20C attach to the cables between these two points and then move downward to a control position. The position of the three hooks are controlled by rack and pinion arrangements 21. By extending the two outer hooks 20A and 20B (upwards) and contracting the middle hook 20C (downwards), a greater tension is placed on the lower cable 9C, while the tension on the higher outer cables 9A, 9B is reduced. In consequence, the missile nozzles 6 will turn to produce a downward force. Similarly, by extending the middle hook 20C and lowering the outer hooks 20A and 20B, the missile nozzles 6 can be made to produce an upward force.

Azimuth control of the missile 1 is provided by rotating the turntable 14 which has the effect of pulling one cable (9A for example) and releasing the other (9B).

The extension and contraction is given by the distance between the outer cables 9A, 9B multiplied by the sine of the angle between the current missile position and the orientation of the turntable 14.

On detection of a threat the turntable moves to the centre of the position of the sector in which the threat was detected. When the position of the threat has been locked by conventional techniques, then from the range and speed information a time to go estimate is calculated. If the time to go is less than 4 seconds but greater than 0.5 of a second then the launch sequence will be initiated. The spindle shaft and the friction brake will be engaged, the cable hooks will be moved to the control position, the turnable will move to the threat's azimuth, the friction brake will be set to give a 1000N tension on the cables and the motor will be ignited.

The missile 1 flies out along the launcher rails 16, which ensure that the missile 1 flies straight initially. Roll control is achieved by ballasting the missile. The pitch torque caused by the offset of the ballast will be countered by the torque from the tether cable 10. This tether cable 10 takes the majority of the strain of the braking force. For the first half a second or so the missile will accelerate due to the resultant forward force (2000N forward, 1000N braking). After this the friction braking can be increased to 3000N thus slowing the missile down to a complete halt. The time taken to do this depends on the maximum strain that can be placed on the cables. With 5000N strain this could be done with 0.7 of a second. The strain on the tether 10 can be monitored inside the missile and when the strain increases to 1000N the warhead will be armed by its safety and arming unit 4.

During flyout control will be maintained by the cable hooks 20A, 20B, 20C (for elevation control) and by control of the turntable (for azimuth control). Effects such as gravity and wind will cause the need for a bias control demand. Closed loop control can be effected by monitoring the position of the missile relative to the tracked threat by an IR scanner. To prevent obscuration of the threat by the missile efflux the missile can be commanded slightly off the line of sight until the threat comes within close range of the launcher.

If the threat turns out to be false or the missile misses the threat the brake is released. The loss of tension on the tether 10 will switch the safety and arming unit 4 to a safe position and will allow the missile 1 to accelerate. Subsequently the cables will run out, the spindles 15 will be released and any remaining cable will be dragged out by the motion of the turntable as it returns to search mode.

I claim:

1. A missile launch and control system comprising: a launch station; a missile having an on-board vectored thrust mechanism; and control cable means, connected at one of its ends to the launch station and at another one of its ends to said vectored thrust mechanism, for controlling the lateral position of said missile in flight.

2. A missile launch and control system according to claim 1 in which said vectored thrust mechanism includes a rotatable ball and at least one exhaust nozzle connected thereto.

3. A missile launch and control system according to claim 2 in which said vectored thrust mechanism further includes control arm means connected at one of its ends to said ball and at another of its ends, to said control cable means.

4. A missile launch and control system according to claim 1 in which said launch station includes means for adjusting the tension on said control cable means.

5. A missile launch and control system according to claim 4 in which the means for adjusting the tension on said control cable means includes moveable cable hooks.

6. A missile launch and control system according to claim 5 in which said moveable cable hooks incorporate a rack and pinion mechanism.

7. A missile launch and control system according to claim 4 in which the means for adjusting the tension on said control cable means incorporates a rotatable turntable.

8. A missile launch and control system according to claim 1 in which said control cable means are supported at the launch station on spindle means which incorporate a friction brake.

9. A missile launch and control system according to claim 1 in which the control cable means are composed of aramid fibre.

* * * * *